United States Patent [19]

Solf et al.

[11] Patent Number: 4,748,876

[45] Date of Patent: Jun. 7, 1988

[54] UNIVERSAL PLIERS

[75] Inventors: Johannes Solf, Sindelfingen; Peter Kern; Gerhard Bayer, both of Stuttgart; Jürgen Reichel, Dettingen, all of Fed. Rep. of Germany

[73] Assignee: SWG Schraubenwerk Gaisbach GmbH & Co., Kunzelsau-Gaisbach, Fed. Rep. of Germany

[21] Appl. No.: 941,395

[22] Filed: Dec. 15, 1986

[30] Foreign Application Priority Data

Dec. 20, 1985 [DE] Fed. Rep. of Germany ..... 3545410

[51] Int. Cl.[4] ..... B25B 7/04

[52] U.S. Cl. ..... 81/341; 81/385; 81/388

[58] Field of Search ..... 81/385, 386, 388, 391, 81/392, 387, 389, 390, 341, 407, 401

[56] References Cited

U.S. PATENT DOCUMENTS

| | | | |
|---|---|---|---|
| 1,136,618 | 4/1915 | Robinson | 81/391 |
| 2,321,430 | 6/1943 | Smith | 81/356 |
| 3,664,214 | 5/1972 | Feldman | 81/129.5 |
| 3,824,882 | 7/1974 | Burthardt . | |

FOREIGN PATENT DOCUMENTS

| | | |
|---|---|---|
| 1126329 | 3/1962 | Fed. Rep. of Germany . |
| 2729231 | 10/1978 | Fed. Rep. of Germany . |
| 3108276 | 9/1982 | Fed. Rep. of Germany . |
| 2529499 | 6/1983 | France . |

OTHER PUBLICATIONS

European Search Report dated Oct. 16, 1987 for Application No. 86117599.

*Primary Examiner*—Frederick R. Schmidt
*Assistant Examiner*—Maurina Rachuba
*Attorney, Agent, or Firm*—Lackenbach, Siegel, Marzullo & Aronson

[57] ABSTRACT

Prior universal pliers with two gripping arms (11, 15) and an adjustable jaw have the disadvantage that during adjustment one must change hands while using the pliers which is unfavourable as regards the economic requirements. This disadvantage is obviated by the present invention in that both gripping arms (11, 15) are non-displaceably articulated on one another and one of the two jaws (19) is displaceably mounted with respect to its associated gripping arm (15) at right angles to the jaw opening.

11 Claims, 3 Drawing Sheets

UNIVERSAL PLIERS

Figure 2:
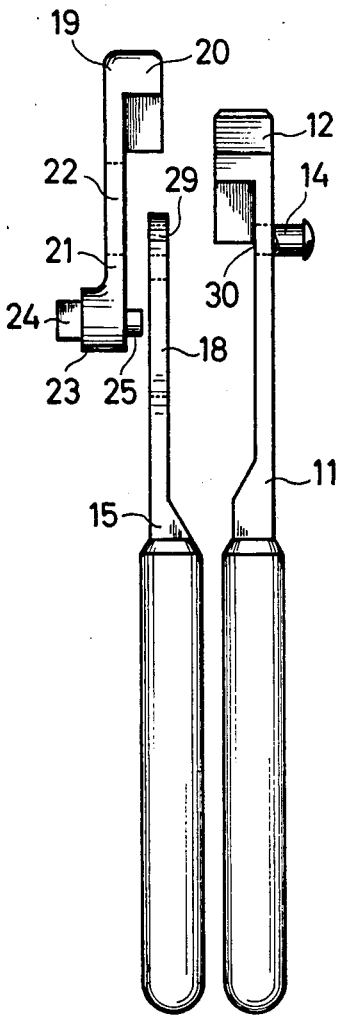

This invention relates to universal or waterpump pliers with a first gripping arm provided on its working end with a first mouth jaw and a second gripping arm connected to the first gripping arm via a pivot pin and with which is associated a second mouth jaw, the reciprocal spacing of the mouth jaws being variable by displacing one jaw with respect to the other.

Universal pliers of this type have a first gripping arm, which is in contact with the inside of the palm of the hand. In the vicinity of its working end it passes into a first jaw. On to the first gripping (palm) arm is articulated a second gripping finger arm, which forms at its working end the second jaw and in the vicinity of its opposite end is clasped by the forefingers of the hand. The mouth formed by the two mouth jaws is at an angle of approximately 60° from the longitudinal axis of the pliers. In order to be able to pick up objects having different diameters, the finger gripping (second) arm is displaceable with respect to the other gripping arm in a direction at right angles to a line of symmetry between the two insides of the jaws. This is e.g. brought about in that the picot pin is formed by a pin member having a non-circular cross-section. For adjustment purposes, the finger gripping (second) arm then has to be swung out a very long way and then adjustment can take place. It is also known that displacement is possible by means of a spindle drive, which leads to a continuous adjustment. Adjustment by means of a grooved bearing is also known.

The disadvantage of all known universal pliers is that for adjusting the mouth width a complicated release of the gripping hand from its gripping position is necessary. In most conventional models adjustment is only possible in the case of an overspread angular position of the gripping arms for which a two-handed operation is necessary. As a result the pliers must be detached from the workpiece. In addition, a large amount of space is required for swinging out the gripping arms. The risk of the pliers slipping is increased by the necessary gripping round.

The overspread angular position of the arms makes it impossible to carry out a direct comparison between the set mouth width and the workpiece thickness during the adjusting process. The adjustment result can only be checked when the arms are in the closed position. The complete process has to be repeated for correction purposes. A particularly serious disadvantage is that through the relative displacement of the fulcrum point with respect to one arm, there is also a relative displacement of the gripping zones of the two arms in the longitudinal direction. This leads to a modification to the contact surface geometry between the grips and therefore to different gripping conditions in the case of the different mouth width positions. Thus, there is greater stressing of the gripping hand, because a good ergonomic gripping zone configuration presupposes a fixed relative position of the arms.

Apart from the longitudinal displacement, there is also a change to the arm spacing. Thus, the hand must close to a differing extent if the same closing forces are to be applied with different mouth widths. Due to the large mouth width, the arm spacing is very small in the case of thick and therefore generally heavy workpieces. This leads to a considerable reduction to the closing forces which can be applied by the hand.

Pliers are already known (US-A-23 21 430), having two mouth jaws, whose insides are parallel to one another and in which one jaw is guided on the other in a transversely displaceable manner. A line of symmetry between the insides of the two jaws runs parallel to the longitudinal axis of the pliers, so that the problem of the longitudinal displacement of the two arms relative to one another cannot occur. The intention of said known pliers is to make the clamping force independent of the width of the mouth position. Swinging of the two arms towards one another in each case leads to a displacement movement of the two jaws relative to one another and not to a pivoting thereof. Thus, here again there is no problem of not being able to directly check on the workpiece the result of the mouth width adjustment.

The object of the present invention is to provide waterpump or universal pliers which, in the case of simple construction, still provide an easily realizable adjustment possibility and in which the hand side of the pliers has an optimum design with respect to ergonomic requirements.

According to this invention this object is achieved in that the gripping arms are mounted in non-displaceable manner on one another and one mouth jaw is constructed as a component separate from said arms. This mouth jaw is displaceably and fixably mounted on a gripping arm. In the case of an adjustment of the mouth width, there is no displacement of the two gripping arms in a longitudinal direction with respect to one another, so that the arm ends can be adapted in an optimum manner in their gripping area to the shape and structure of the human hand. It is now possible to adjust the mouth width with an unchanged position of the gripping arms, so that over-spreading is now no longer necessary. Adjustment can take place in the working position of the pliers, so that there can be an immediate comparison of the mouth width with the workpiece to be held.

According to a further development, the displaceable jaw is mounted on the finger gripping (second) arm of the pliers. Advantageously the displaceable jaw has an arm roughly at right angles thereto with an oblong hole, which is traversed by the pivot pin. This means that the kinematics of handling the universal pliers undergoes no change in its working zone. The upper jaw is also pivoted about the pivot pin of the pliers in the case of the known universal pliers.

According to a further development the displaceable jaw is guided on the gripping end of the second arm. The guide in this portion, particularly in conjunction with the oblong hole traversed by the pivot pin, forms a mounting support at two spaced points, so that despite the construction of the jaw as a separate component, the pliers have an excellent strength.

Generally fixing in several discrete positions is possible in the case of prior universal pliers. According to the invention this displaceable jaw has an adjustment means for fixing the same in several positions on the (second) gripping arm. These can be discrete positions, which optionally have catches.

Adjustment means is provided if there is an optional spring loaded pushbutton, which engages a locking member in one of several positions. This pushbutton is advantageously arranged in an area which can be reached by the thumb of the gripping hand. The pliers can then be adjusted with one hand without having to release the same.

According to the invention a spring can act on the displaceable jaw for the purpose of increasing the mouth width. Then, in use, the pliers are moved up the workpiece to be held, the displaceable jaw is moved in until it contacts the workpiece and the adjustment means is released.

To improve the guidance of the displaceable jaw or for increasing the stability of the pliers, according to the invention the displaceable jaw has an arm portion constructed as a double arm for sticking through at least one gripping arm. This leads to better guidance without any possibility of tilting.

Apart from fixing the displaceable second jaw in different discrete positions, the second jaw can e.g. be fixed by frictional resistance on lateral guides of the gripping arm. This not only leads to a continuous adjustable modification of the mouth width, but in addition no additional means are required for locking purposes.

With particular advantage the second gripping arm has a double T-shaped guideway, along which can be moved a displaceable jaw having a double arm and on which it engages by frictional resistance. Thus, including the pivot pin, the pliers only comprise four parts, whilst simultaneously providing a continuous adjustment possibility.

It is also advantageously possible for the adjusting means to have a screw spindle.

Figure 1:
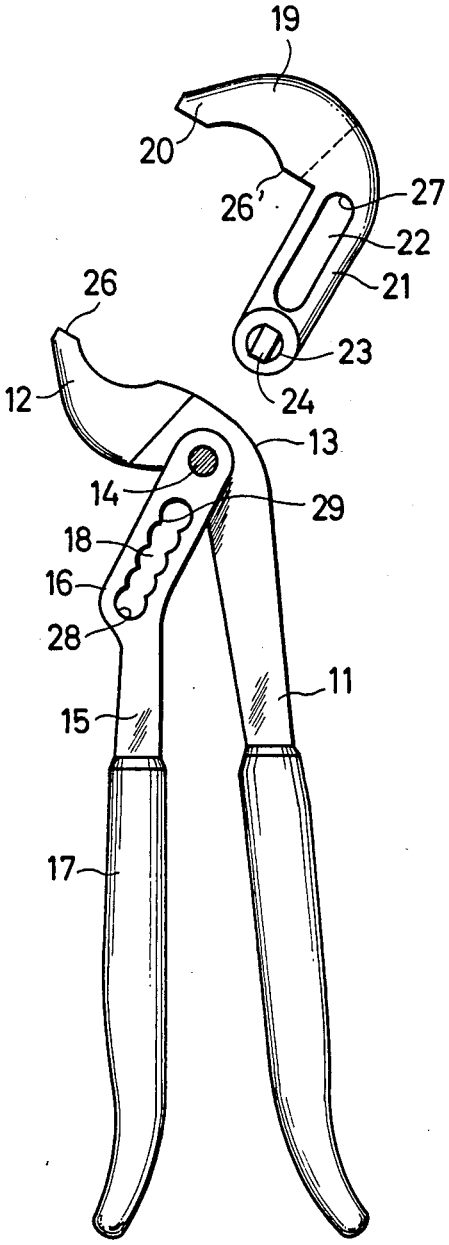

Further features, details and advantages of the invention can be gathered from the following description of preferred embodiments relative to the drawings, wherein show:

FIG. 1 A wide side view of universal pliers proposed by the invention with the displaceable mouth jaw removed.

FIG. 2 Details of the universal pliers according to FIG. 1 in a narrow side view from the right of FIG. 1.

Figure 3:
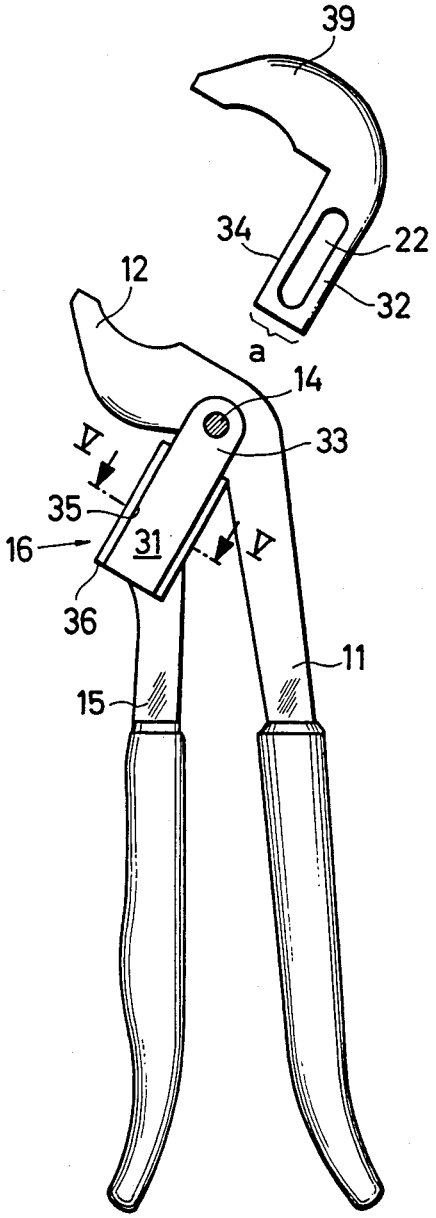

FIG. 3 A wide side view corresponding to FIG. 1 of a further embodiment.

Figure 4:
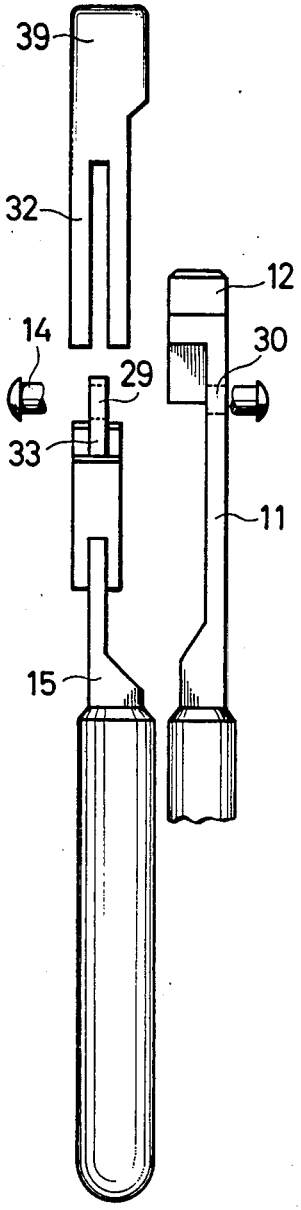

FIG. 4 A narrow side view corresponding to FIG. 2 of details of the pliers according to FIG. 3.

Figure 5:
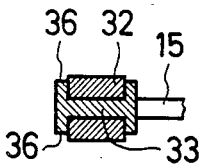

FIG. 5 A section along line V—V of FIG. 3.

Figure 6:
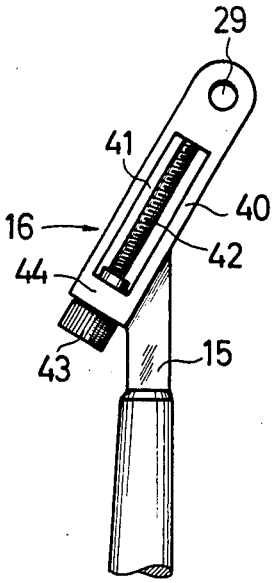

FIG. 6 A partial view of a finger gripping arm in another embodiment.

Figure 7:
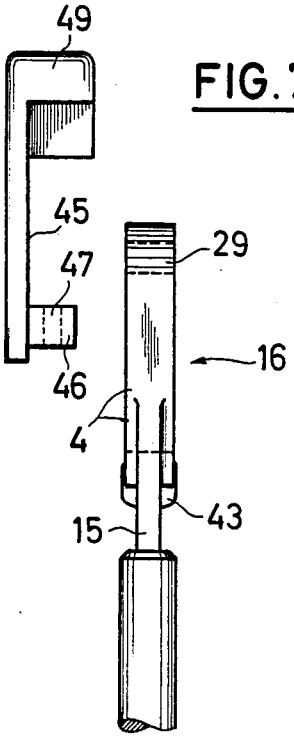

FIG. 7 A narrow side view of the finger gripping arm and the displaceable jaw associated therewith of the embodiment according to FIG. 6.

Figure 8:
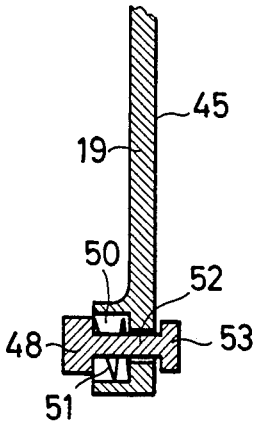

FIG. 8 A partial section through a displaceable jaw with a fixing device.

The universal pliers shown in FIG. 1 has a first gripping arm 11, which from its lower grip end in FIG. 1 runs initially approximately linearly and is then bent from its longitudinal direction by approximately 60°. In said bent area the gripping arm 11 forms a first jaw 12. In the vicinity of the bend 13 between the linear part of gripping arm 11 and jaw 12, said arm 11 is traversed by a pivot pin 14 in the form of a pin member. The second gripping arm 15 is articulated to pivot pin 14 and in the represented embodiment it constitutes the finger gripping arm. Whereas the first gripping arm 11 behaves as a two-arm lever with respect to pivot pin 14, the finger gripping arm 15 extends essentially only on one side of pivot pin 14. Immediately adjacent to the latter, it initially forms a linearly directed portion 16, to which is connected a further roughly linear portion 17, but which forms an angle with the first portion 16. In the vicinity of the linear guide portion 16 is provided an elongated opening 18 which is centrally positioned with respect to guide portion 16 and whose shape corresponds to that of several juxtaposed, partly overlapping circles.

With the finger gripping arm 15 is associated the second jaw 19, which has a jaw portion 20 and an arm 21 extending roughly at right angles thereto. The shape of jaw portion 20 roughly corresponds to that of the first jaw 12, but is linear symmetrical to a parting line between both jaws. The shape and size of arm 21 of displaceable jaw 19 roughly corresponds to guide portion 16 of finger gripping arm 15. Arm 21 has an oblong hole 22, whose width roughly corresponds to the diameter of pivot pin 14. A thickened portion 23, in which is mounted a rotary knob 24, is arranged in the vicinity of the end of arm 21. Jaw 19 which is constructed as a separate component is connected to the universal pliers in such a way that the pivot pin 14 passes through oblong hole 22 and has a widened head outside arm 21. On the back, which is not visible in FIG. 1, arm 21 receives in the extension of rotary knob 24 a projection 25, which engages in opening 18 (cf. FIG. 2). Thus, jaw 19 is connected to the second finger gripping arm 15, so that it does not rotate about pivot pin 14. However, as a function of the position of projection 25, jaw 19 can be displaced by the extent permitted by the length of oblong hole 22 and opening 18. In one end position, the insides 26, 27 of the two jaws 12, 19 engage on one another in the represented position of gripping arms 11, 15 and in this position simultaneously pivot pin 14 engages on the upper end 27 of oblong hole 22 and projection 25 engages on the lower end 28 of opening 18.

The cross-section of projection 25 is chosen in such a way that in one direction it roughly corresponds to the diameter of the circles forming opening 18. In a direction at right angles thereto, the size of projection 24 is smaller than the spacing of two facing tips 29 of opening 18. If projection 25 is now turned with the aid of rotary knob 24 in such a way that its larger dimension is at right angles to the longitudinal direction of opening 18, then jaw 19 is locked. By turning by 90°, projection 25 comes into a position in which jaw 19 can be displaced for adjusting the mouth width.

FIG. 2 shows the details of the universal pliers represented in FIG. 1 in a narrow side view. It can be seen that the jaw has a greater width than the rest of the first gripping arm 11, which also applies with respect to jaw 20 and its arm 21. Second finger gripping arm 15 is placed alongside the first gripping arm 11 in such a way that the swinging opening 29 therein coincides with a swinging opening 30 of gripping arm 11. Pivot pin 14 is then passed through the aligned openings 30, 29. From the outside the displaceable jaw 19 is then fitted in such a way that pivot pin 14 passes through oblong hole 22. On the outside of jaw 19, the pin is then given a thickened head. The projection 25 projecting on the inside of jaw 19 is placed in opening 18.

In the embodiment according to FIG. 3, the guide portion 16 of the finger gripping arm 15 has a guideway 31, which is cross-sectionally shaped like a double T. The displaceable jaw 39 again has an arm 32 with an oblong hole 22. As can be gathered from FIG. 5, arm 32 is constructed as a double arm, the two portions of double arm 32 being parallel to one another and having a uniform internal spacing. The displaceable jaw 39 is placed on the finger gripping arm 15 in such a way that the two portions of double arm 32 enclose between them the web 33 of guideway 31. The width a of the double arm 32 corresponds to the width of guideway 31, so that the longitudinal edges 34 engage on both sides on the insides 35 of webs 36 of the double T-profile of guideway 31. After placing the displaceable jaw 39 on guideway 31 of finger gripping arm 15, pivot pin 14 is passed through the aligned openings 29, 30 and forms a head on either side. For as long as no closing force is exerted on the pliers, in this case the displaceable jaw 39 can be easily moved in the longitudinal direction of oblong hole 22, i.e. at right angles to the line of symmetry between the insides of the two jaws 12, 39. As soon as force is exerted on the grips of the two arms, there is a slight tilting, so that the longitudinal edges 34 of both portions of double arm 32 engage on all four insides 35 of webs 36 of guideway 31. This is a particularly simple and advantageous embodiment of the invention and is therefore preferred.

FIG. 6 shows an individual view of a further guideway 16 in a further embodiment. In this case guideway 16 of a finger gripping arm 15 is constructed as a solid beam 40, which has an opening 41 in the form of a rectangle. A screw 42 extending in the longitudinal direction of opening 41 and in the longitudinal direction of guide portion 16 is rotatably arranged in opening 41. The screw head 43 provided with longitudinal grooving is accessible from outside the guide portion 16. With the aid of head 43, screw 42 can be turned about its own longitudinal axis, so that an element secured against rotation and held in the rectangular opening is moved in the longitudinal direction of the screw. The screw engages through a thread-free bore through the lower end 44 of guide portion 16. Thus, rotation thereof is possible. In the embodiment according to FIG. 6 on the inside 45 of displaceable jaw 49 is provided an attachment 46, whose width measured at right angles to the plane of the paper corresponds to the width of opening 41. Attachment 46 contains a threaded bore 47 running in the longitudinal direction. If attachment 46 is placed in opening 41 and subsequently the screw is fitted, a rotation of head 43 leads to a longitudinal displacement of attachment 46 in opening 41 and therefore to a displacement of jaw 49 for modifying the mouth width.

Whereas in the case of the embodiment according to FIG. 1 a rotary knob is used for releasing the fixing of the displaceable jaw 19, a pushbutton 48 is used in the embodiment according to FIG. 8. Pushbutton 48 is arranged in a recess 50 of displaceable jaw 19, which also has a spring 51. On the inside of pushbutton 48 is fitted a shank 52, which is provided with a widened head 53 on the inside 45 of jaw 19. In the represented position forced by spring 51, the widened head 53 is in opening 18 of guide portion 16 of finger gripping arm 15, from which it can be expelled by pressing on the back of pushbutton 48, so that the narrower shank 52 then permits a displacement. In place of the pushbutton or rotary know, it is also possible to use a pushbutton which automatically leads to a rotation on depressing.

Advantageously oblong hole 22 or parallel thereto contains a spring in the embodiment according to FIGS. 1 to 5, said spring being supported on the one hand on the displaceable jaw and on the other on pivot pin 14, said spring forcing the jaw into the greatest width position.

We claim:

1. Universal pliers comprising:

(a) a first palm-gripping arm having a handle, a first connecting shank and a fixed first jaw at its working end, and pivot means at the junction of said shank and said fixed jaw;

(b) a second finger gripping arm having a handle, and a second shank pivotably mountable at its end to the pivot means of the first arm, said second shank having a plurality of cut-out pin-receiving means; and (c) a detachable member having at the connecting end, pin means adjustably insertable into the pin-receiving cut-out means in the second shank, a third shank having adjustable pivot receiving means adapted to receive the pivot means of the second arm, and at the working end a second jaw cooperatively aligned to the first fixed jaw;

whereby adjustably setting the pin means of the detachable member in the pin-receiving cut-out means of the second shank and the pivot means of the second arm in the pivot receiving means of the third shank adjusts the distance between the first and second jaws to seize workpieces of various sizes.

2. Universal pliers as in claim 1, wherein the third shank is coaxially connected to the second shank at right angle to the engagement surface of the first shank, and the third shank's pivot receiving means is an oblong cut-out.

3. Universal pliers as in claim 1, wherein the connecting end pin means of the detachable member connects to the pin-receiving cut-out means in the second shank from the first palm-gripping arm side.

4. Universal pliers as in claim 1, wherein the plurality of cut-out pin-receiving means in the second shank are linearly constructed to enable adjustment of the distance between the first and second jaws to any one of several lockable positions.

5. Universal pliers as in claim 4, further comprising a springloaded pushbutton in the second shank for locking the detachable member into any one of the lockable positions.

6. Universal pliers as in claim 1, further comprising a biasing spring connected between the second jaw and the pivot pin of the two gripping arms.

7. Universal pliers as in claim 1, wherein the angle between the axis of the closed handles and a line connecting the jaws is about 60°.

8. Universal pliers comprising:

(a) a first palm-gripping arm having a handle, a first connecting shank and a fixed first jaw at the working end, and pivot means at the junction of said shank and said fixed jaw;

(b) a second finger gripping arm having a handle, and a second shank pivotably mountable at its end to the pivot means of the first arm, said second shank having parallel frictional guides of double T-shaped cross-section adapted to receive and adjustably hold a split double-arm oblong; and (c) a detachable member having at its connecting end a split double-arm oblong insertable into the frictional guides of double T-shaped cross-section of the second shank, a third shank having a cut-out for adjustably receiving a pivot pin of the pivot means of the second arm, and at the working end a second jaw cooperatively aligned to the first fixed jaw;

whereby adjustably sliding the split double arm connecting end of the detachable member up and down in the frictional guides of the second shank and consequently sliding the pivot pin of the pivot means of the second shank of the finger gripping arm in the cut-out of the third shank adjusts the distance between the first and second jaws to seize workpieces of various sizes.

9. Universal pliers as in claim 8, wherein the third shank is coaxially connected to the second shank at right angle to the engagement surface of the first shank and the third shank's pivot pin receiving cut-out is oblong.

10. Universal pliers as in claim 8, further comprising a biasing spring connected between the second jaw and the pivot pin of the two gripping arms.

11. Universal pliers comprising:

(a) a first palm-gripping arm having a handle, a first connecting shank and a fixed first jaw at the working end and pivot means at the junction of said shank and said fixed jaw;

(b) a second finger gripping arm having a handle and a second shank pivotably mountable at its end to the pivot means of the first arm, said second shank having an adjusting screw means with an adjusting head mounted in the axis of said second shank; and (c) a detachable member having a connecting end, a third shank and a second adjustable jaw at its working end, said third shank having a threaded bore cooperatively mounted to receive the adjusting screw means mounted on the second shank;

whereby turning the adjusting head rotates the adjusting screw in the threaded bore of the third shank thus adjusting the distance between the first and second jaws to seize workpieces of various sizes.

* * * * *